US005941433A

United States Patent [19]

Wilcher

[11] Patent Number: 5,941,433

[45] Date of Patent: Aug. 24, 1999

[54] MEDICATION ATTACHMENT DEVICE AND METHOD

[76] Inventor: Lisa Lynn Wilcher, 10 Blackberry La., Charleston, W. Va. 25304

[21] Appl. No.: 08/989,706

[22] Filed: Dec. 12, 1997

[51] Int. Cl.[6] ..... A45F 5/00

[52] U.S. Cl. ..... 224/191; 224/220; 224/269

[58] Field of Search ..... 224/191, 194, 224/217, 220, 269, 609; 206/470, 467, 528, 538, 539, 540, 530, 531; 24/3.1; 220/423; 36/136

[56] References Cited

U.S. PATENT DOCUMENTS

| | | | |
|---|---|---|---|
| 1,413,064 | 4/1922 | Salfisberg | 206/538 |
| 1,493,594 | 5/1924 | Binns | 224/677 |
| 2,234,655 | 3/1941 | Salfisberg | 206/539 |
| 3,567,013 | 3/1971 | Tannenbaum | 206/42 |
| 3,618,751 | 11/1971 | Rich | 206/47 R |
| 3,743,084 | 7/1973 | Douglas | 206/42 |
| 3,899,080 | 8/1975 | Brunda | 206/531 |
| 3,921,804 | 11/1975 | Tester | 206/531 |
| 4,166,535 | 9/1979 | Gilling | 206/470 |
| 4,830,248 | 5/1989 | Pommenville | 224/269 |
| 4,911,304 | 3/1990 | Bunin | 206/531 |
| 5,090,570 | 2/1992 | Todd | 206/463 |
| 5,129,560 | 7/1992 | Herman | 224/579 |
| 5,242,005 | 9/1993 | Borgardt | 160/118 |
| 5,370,286 | 12/1994 | Newman | 224/151 |
| 5,549,204 | 8/1996 | Toren | 206/539 |
| 5,609,246 | 3/1997 | Borghorst et al. | 206/5.1 |

*Primary Examiner*—Allan N. Shoap
*Assistant Examiner*—Maerena W. Brevard
*Attorney, Agent, or Firm*—Baker & Botts, L.L.P.

[57] ABSTRACT

A medication attachment device and method are disclosed for attaching medication in close proximity to a body. The device includes a container for holding medication and an attachment mechanism coupled to the container. The attachment mechanism is operable to attach the container to personal apparel, such as clothing, accessories or jewelry. In one embodiment, the attachment mechanism is a flexible body that can be wrapped around the personal apparel. In another embodiment, the attachment mechanism is a clamp formed by a hinge portion that can be clamped to the personal apparel.

1 Claim, 2 Drawing Sheets

MEDICATION ATTACHMENT DEVICE AND METHOD

TECHNICAL FIELD OF THE INVENTION

The present invention relates in general to the field of packaging for medication and, more particularly, to a medication attachment device and method for attaching medication in close proximity to the body.

BACKGROUND OF THE INVENTION

Recent studies have shown that some medications taken quickly after the onset of certain medical conditions can greatly enhance survival and recovery. For example, it has been shown that heart attack victims can greatly increase their chance of survival if they quickly take an aspirin after onset of the attack. It can also be important for heart attack victims to have quick access to nitroglycerin. Unfortunately, few people carry aspirin, or other helpful emergency medications, with them wherever they go. This is particularly true with respect to men because of the lack of a purse or other convenient compartment for carrying medication. Also, with increasing numbers of people exercising (e.g., walking, hiking, biking, etc.), people are away from emergency medication while engaging in activities that may aggravate medical conditions such as heart and lung problems. Even people who do carry aspirin, or other medications, are likely carry them somewhere where the medication is not readily accessible in a medical emergency (e.g. a purse or briefcase).

There presently exist a number of different ways of packaging medication (e.g., pills, capsules, tablets, vials, etc.) for consumer use. For example, various medication packaging systems are disclosed in U.S. Pat. No. 5,242,005; U.S. Pat. No. 3,899,080; U.S. Pat. No. 3,921,804; U.S. Pat. No. 5,609,246; U.S. Pat. No. 3,618,751; U.S. Pat. No. 5,549,204; U.S. Pat. No. 3,743,084; and U.S. Pat. No. 4,911,304. One focus of innovation in medication packaging, in addition to maintaining the integrity of the medication, has been to prevent unsupervised access, for example, by children. However, conventional medication packaging solutions do not address the problem of allowing quick access to the medication during an emergency.

SUMMARY OF THE INVENTION

In accordance with the present invention, a medication attachment device and method for attaching medication in close proximity to the body are disclosed that provide advantages over previously developed medication packaging schemes.

According to one aspect of the present invention, the medication attachment device includes a container for holding medication and an attachment mechanism coupled the container. The attachment mechanism is operable to attach the container to personal apparel, such as clothing, accessories or jewelry. In one embodiment, the attachment mechanism is a flexible body that can be wrapped around the personal apparel. In another embodiment, the attachment mechanism is a clamp formed by a hinge portion that can be clamped to the personal apparel.

A technical advantage of the present invention is to provide a simple, easily accessible device and method for attaching medication to personal apparel, such as clothing, accessories or jewelry, to assist people in quickly finding and accessing their medication in an emergency.

Another technical advantage of the present invention is that lives may be saved and recoveries improved if people can quickly and simply access medication in an emergency. For example by attaching a waterproof medication container to a shoelace, the medication can be readily available at all times without the necessity of searching through purses, bags, briefcases, cabinets, etc.

Additional technical advantages should be readily apparent from the drawings, description, and claims.

BRIEF DESCRIPTION OF THE DRAWINGS

A more complete understanding of the present invention and advantages thereof may be acquired by referring to the following description taken in conjunction with the accompanying drawings, in which like reference numbers indicate like features, and wherein.

DETAILED DESCRIPTION OF THE INVENTION

Figure 1:
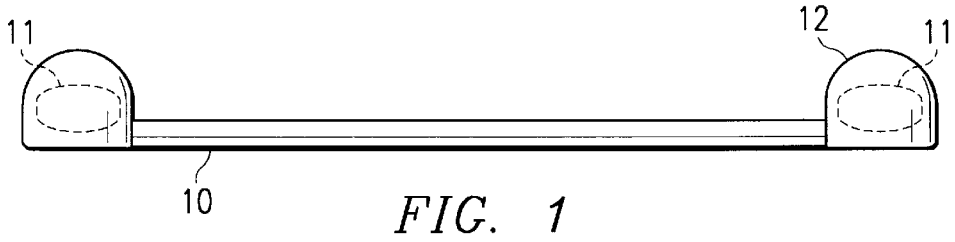
FIG. 1 is a side view of one embodiment of a medication attachment device.

FIG. 1 is a side view of one embodiment of a medication attachment device. As shown, the medication attachment device comprises a flexible body 10 coupled to a pair of containers 12 that each hold doses of medication 11. Flexible body 10 provides an attachment mechanism for the medication attachment device. In one implementation, the containers 12 can be blister packs for holding the medication 11, and the flexible body 10 can be constructed from materials such as flexible, waterproofed wire or twistable plastic. Thus, the blister pack containers 12 can have an attachment mechanism provided by the flexible body 10 (e.g., a strip or band) that allows the containers 12 to be attached to personal apparel in close proximity to the body for access in an emergency.

Figure 2:
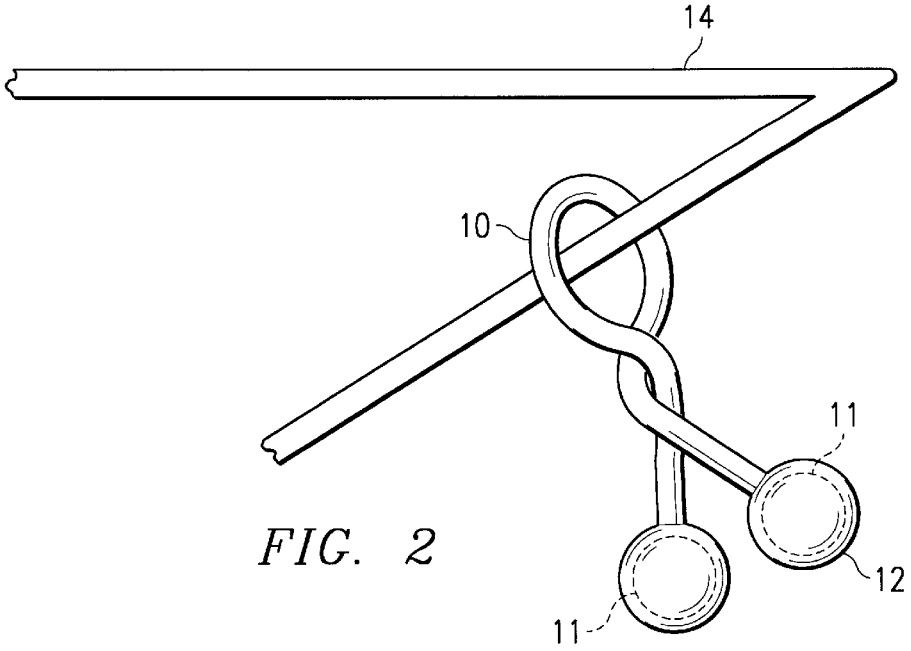
FIG. 2 is a diagram of the medication attachment device of FIG. 1 attached to personal apparel.

FIG. 2 is a diagram of the medication attachment device of FIG. 1 attached to personal apparel 14. As shown, the flexible body 10 operates as an attachment mechanism to attach the containers 12 to the personal apparel 14, which can include clothing, accessories or jewelry. In particular, personal apparel 14 can be a rope-like or belt-like strand of material such as a shoe-lace or belt (generally referred to herein as a "linear article"). As mentioned, the device can have two blister pack containers 12 of sufficient size to hold a single dose of medication. The blister pack containers 12 are held together and attached to the personal apparel 14 by the flexible, waterproof body 10.

The flexible body 10 need only be long enough to wrap securely around the personal apparel 14 to which the device is to be attached. For example, the medication attachment device can be attached to a shoelace in an over-under, wrapping manner as shown in FIG. 2. Where the personal apparel is a shoelace or other linear article, the flexible body 12 can be relatively short allowing the medication attachment device to be small and unobtrusive.

Figure 3:
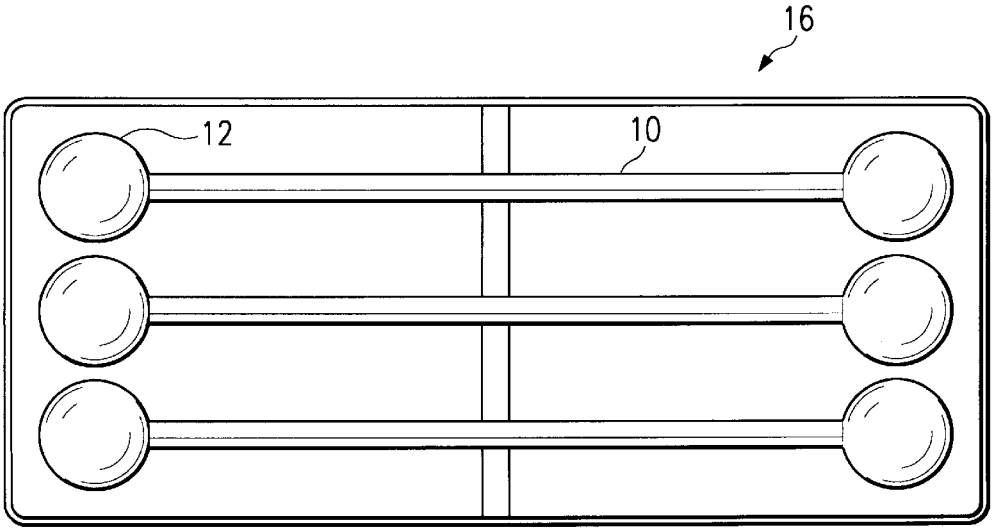
FIG. 3 is a top view of one embodiment of packaging for multiple medication attachment devices like that of FIG. 1.

FIG. 3 is a top view of one embodiment of packaging, indicated generally at 16, for multiple medication attachment devices like that of FIG. 1. In this embodiment, the flexible bodies 10 are aligned substantially parallel and the containers 12 are aligned on opposites sides of the packaging 16.

Figure 4:
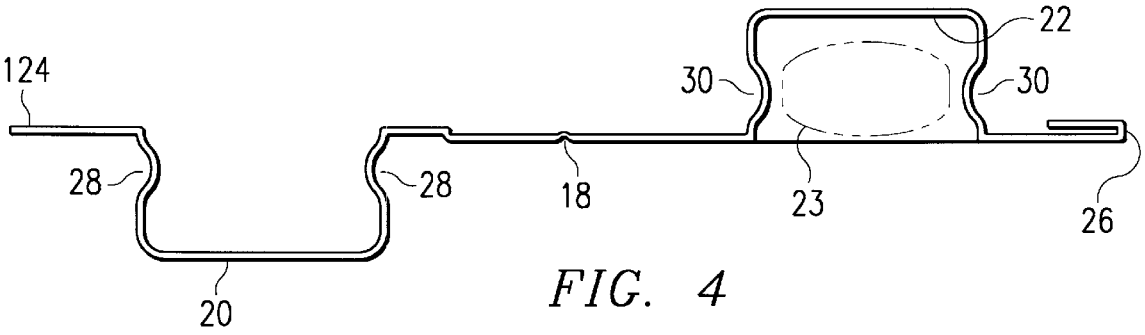
FIG. 4 is a side view of another embodiment of a medication attachment device in an open, unhinged state.

FIG. 4 is a side view of another embodiment of a medication attachment device in a open, unhinged state. As shown, the medication attachment device includes a hinge portion 18 located substantially in the center of the device. A hollow chamber 20 is located to one side of hinge portion 18, and a container 22 is located on the other side of hinge portion 18. Container 22 holds medication 23 and can be a blister pack or other type of container. In order to allow the medication attachment device to be attached to personal apparel, one end portion 24 of the device is formed to secure within a fold over flap of the other end portion 26. Further, the chamber 20 has ridges 28 formed in its interior that can engage notches 30 formed on the periphery of the container 22.

Figure 5:
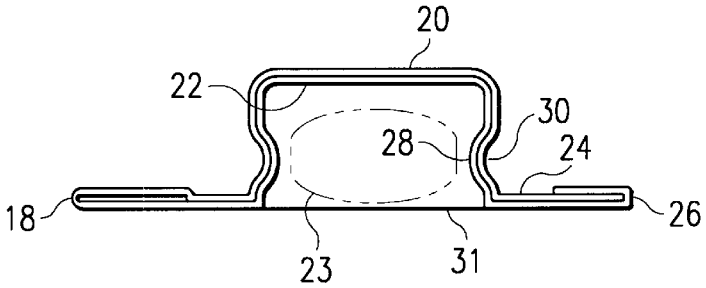
FIG. 5 is a side view of the medication attachment device of FIG. 4 in a closed, hinged state.

FIG. 5 is a side view of the medication attachment device of FIG. 4 in a closed, hinged state. As shown, an integral attachment mechanism is formed by the hinge portion 18, the end portions 24 and 26, and the ridges and notches 28 and 30. The hinge portion 18 allows the device to be folded upon itself. The device can then be secured by the male/female snapping mechanism of chamber 20 and container 22 and by the folding of end portion 26 around end portion 24. A peel/back cover layer 31 can allow easy access to the medication 23 when the device is in this closed, hinged state. The unobtrusive placement of the medication attachment device when attached can allow convenient and easy access to various medications. The device can be small enough to make it suitable for various outdoor, wilderness and sporting activities.

Figure 6:
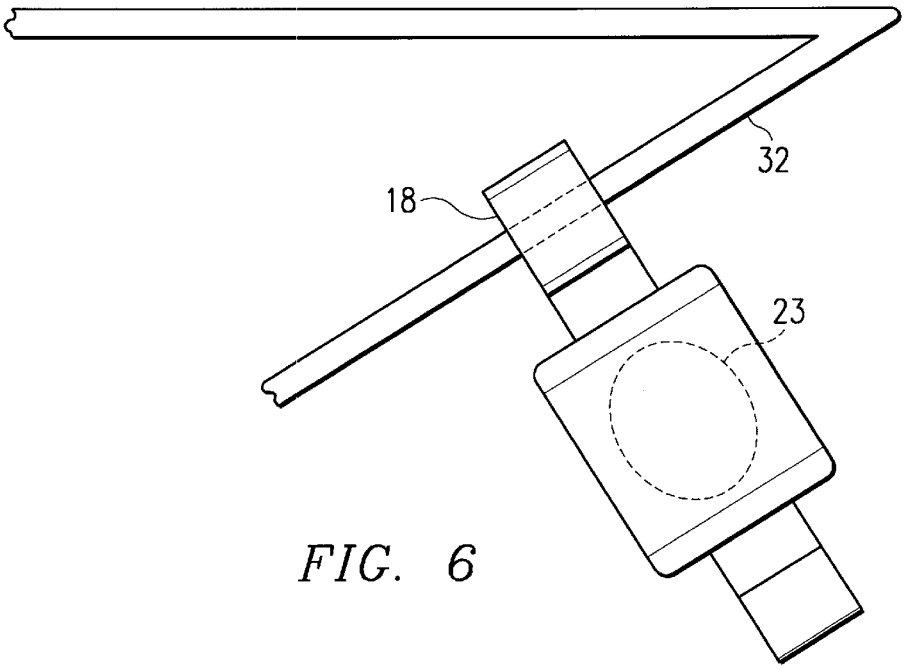
FIG. 6 is a diagram of the medication attachment device of FIG. 4 attached to personal apparel.

FIG. 6 is a diagram of the medication attachment device of FIG. 4 attached to personal apparel 32. As shown, in order to attach the device to personal apparel 32, personal apparel 32 is clamped within hinge portion 18. In particular, personal apparel 32 can be a shoelace or other linear article of personal apparel.

If a person were to attach the device to all the various shoes they wore, this would ensure almost constant access to desired medication. However, a natural concern would be the aesthetic appearance of the device. In order to make the device aesthetically neutral, the container and the attachment means could be colored in various ways to blend into the personal apparel such as shoes and/or shoelaces (or the device could be tucked out of view behind the shoelace or other apparel). Further, the device can be constructed of durable yet lightweight material to make it as unnoticeable as possible.

In general, the present medication attachment device and method provide an improved container for medication that can be attached in close proximity to the body for easy access. The device can use inexpensive, waterproof containers for medications (e.g., pills, capsules, tablets, vials, etc.) coupled to or formed integral with various attachment mechanisms. As indicated above, the present method and apparatus provide significant benefits for consumers with a desire to have easy, simple and ready access to their medication.

The container portion of the attachment device could contain medication in any form, but typically would be designed to hold pills, tablets, capsules, vials and other common medication formats. Accordingly, the container could come in a variety of different shapes, sizes and configurations. Likewise, the container could be manufactured from a variety of different substances such as plastics, films, foils and various metals. It can also be waterproof and durable. One possibility, as mentioned above, is for the container to be a blister pack. Blister packs are well known in the packaging industry and examples are disclosed in various patents such as U.S. Pat. No. 3,809,221; U.S. Pat. No. 5,549,204; and U.S. Pat. No. 4,911,304. Blister packs allow easy access to the contained pill by simply pushing the pill through a breakable barrier.

The medication attachment device also has the attachment mechanism which is connected to or formed integral with the container portion. The attachment mechanism is designed to allow the container to attach to personal apparel in close proximity to the body. There are a myriad of various attachment mechanisms available such as tying, wrapping, clamping, Velcro, magnetizing, gluing, sewing, buttoning, zipping, locking and so forth.

Although the present invention has been described in detail, it should be understood that various changes, substitutions and alterations can be made hereto without departing from the spirit and scope of the invention as defined by the appended claims.

What is claimed is:

1. A method for attaching medication in close proximity to a body, comprising:

providing a first container and a second container for holding the medication, the containers attachable to personal apparel by a flexible body coupled between the containers; and attaching the containers to the personal apparel to position the medication proximate the body by twisting the flexible body around the personal apparel, the personal apparel comprising a linear article which is a shoelace.

* * * * *